United States Patent [19]

Joshi

[11] Patent Number: 4,493,786

[45] Date of Patent: Jan. 15, 1985

[54] TRANSLUCENT SOAPS AND PROCESSES FOR MANUFACTURE THEREOF

[75] Inventor: David P. Joshi, Plainfield, N.J.

[73] Assignee: Colgate-Palmolive Company, New York, N.Y.

[21] Appl. No.: 414,443

[22] Filed: Sep. 2, 1982

[51] Int. Cl.[3] ..... C11D 9/48; C11D 9/50; C11D 13/08; C11D 13/14

[52] U.S. Cl. ..... 252/368; 252/108; 252/117; 252/118; 252/122; 252/132; 252/134; 252/153; 252/158; 252/369; 252/370; 252/548; 252/DIG. 16; 252/DIG. 5

[58] Field of Search ..... 252/108, 117, 118, 122, 252/132, 134, DIG. 16, DIG. 5, 368, 369, 370, 153, 548, 158

[56] References Cited

U.S. PATENT DOCUMENTS

| | | | |
|---|---|---|---|
| 2,005,160 | 6/1935 | Pape | 252/134 |
| 2,970,116 | 1/1961 | Kelly et al. | 252/368 |
| 3,562,167 | 2/1971 | Kamen et al. | 252/134 X |
| 3,793,214 | 2/1974 | O'Neill et al. | 252/118 X |
| 3,864,272 | 2/1975 | Toma et al. | 252/370 X |
| 3,926,828 | 10/1975 | O'Neill et al. | 252/132 X |
| 3,969,259 | 7/1976 | Lages | 252/132 X |
| 4,165,293 | 8/1979 | Gordon | 252/117 X |
| 4,206,069 | 6/1980 | Borrello | 252/117 X |
| 4,290,904 | 9/1981 | Poper et al. | 252/132 X |
| 4,297,230 | 10/1981 | Rasser | 252/134 X |

FOREIGN PATENT DOCUMENTS 7009442 3/1977 Japan .

OTHER PUBLICATIONS

McCutcheon's Detergents and Emulsifiers, North American Edition, 1980 Annual, p. 171.

*Primary Examiner*—John E. Kittle
*Assistant Examiner*—Mukund J. Shah
*Attorney, Agent, or Firm*—Herbert S. Sylvester; Murray M. Grill; John A. Stemwedel

[57] ABSTRACT

Translucent soap cakes, which preferably are transparent, are made from mixed tallow and coconut oil soaps (or equivalents), lanolin soap and/or lanolin fatty acids and/or lanolin and/or other suitable derivative(s) thereof, and mixtures thereof, and water. Soap cakes or tablets of improved translucency (transparency) result when the lanolin soap, lanolin fatty acid, lanolin or suitable derivative thereof, or any mixture thereof is mixed at elevated temperature with substantially all of other soap cake components, except perfume (and possibly some other relatively minor constituents), and the resulting mixture is partially dried at elevated temperature, worked, extruded, cut into blanks and pressed to shape. The translucent soap cakes resulting, which may preferably be superfatted and contain a suitable antibacterial component, lather well, are of stable translucency on storage and are desirably mild to the skin. Translucency of the product may be further improved when there is also present in the soap cake formula a soap crystallization inhibiting polyol of 3 to 6 carbon atoms and 2 to 6 hydroxyl groups, such as glycerol or sorbitol.

Also described are translucent soap-synthetic detergent cakes, variegated and at least partially translucent soap cakes and soap-syndet tablets, and pearlescent and at least partially translucent such products. Improved manufacturing processes are disclosed and an improved method for measuring product translucency is described.

20 Claims, No Drawings

TRANSLUCENT SOAPS AND PROCESSES FOR MANUFACTURE THEREOF

This invention relates to translucent soaps and to processes for the manufacture thereof. More particularly, it relates to transparent soaps which contain lanolin soap and/or lanolin fatty acids, and which are of improved translucency or transparency.

Translucent and transparent soap cakes and tablets have been moderately successfully marketed in relatively limited amounts for many years. Initially, such products were made by incorporating clarifying agents (or soap crystallization inhibitors), such as lower alkanols, and the soaps were framed, not milled and plodded. Subsequently, it was discovered that milled and plodded translucent soaps could be made by various methods, including carefully regulating electrolyte content, utilizing resin soaps, employing some potassium soap, controlling moisture content and incorporating specified proportions of trans-oleic acid, hydrogenated castor oil soap, polyalkylene glycols, sugars, tetrakis (hydroxyalkyl) ethylene diamine, or specific organic and inorganic salts in the soap. Also, careful control of the working of particular formulations and energy added to them during processing was in some cases found to be useful in making translucent soap tablets by a process which included plodding of the soap and pressing of lengths cut from extruded plodder bar.

Although prior art transparent and translucent soap tablets could be made, the manufacturing processes, and often many products too, had not been completely satisfactory. For example, some of the crystallization inhibitors, intended to prevent the production of opaque soap crystal masses, caused aesthetic problems, often making the soap malodorous or adversely affecting its tactile properties. Some additives tended to evaporate readily during processing and storage, thereby causing processing difficulties, increasing operating expenses and sometimes causing the product to lose transparency. Some inhibitors could cause the development of hard specks in the soap and others could make the soap mushy or liable to slough excessively when it became wet, as when standing in a soap dish with water in contact with the cake bottom. When the electrolyte content of the soap had to be strictly controlled to produce a transparent soap, special kettle soaps might have to be made and the employment of adjuvants containing electrolytes would be limited. When certain working conditions were required to produce a soap which would be transparent after milling, plodding and pressing, the processes employed would often take too long to be economical, or the process control would be too critical, so that excessive scrapping of off-specification product could result.

The present invention is based on the discovery that lanolin soap, lanolin fatty acids, lanolin or suitable derivatives thereof, or mixtures of two or more of these, when properly incorporated in a suitable soap base, inhibit crystallization of the soap and promote the production of transparent or translucent soap cakes, which can be manufactured by process similar to those employed in the making of commercial milled and plodded soaps. The processing parameters, while desirably regulated for best production, are not as critical as those for many of the prior art processes. The lanolin material utilized as an anti-crystallization component of the soaps, in addition to preventing soap crystallization and consequent opacity, is a desirable component of the soap, acting to soften the skin washed with the soap, tending to improve the stability of the soap against dry cracking, and improving the lathering characteristics of the soap. It has been found that to obtain the improved translucency mentioned it is highly desirable for the "lanolin material" to be mixed at an elevated temperature with the soap and dried so that the dried mixture has a moisture content in the 5 to 25% range, after which it may be blended or amalgamated with perfume and some minor adjuvants (water may also sometimes be added), worked, extruded, cut to lengths and pressed to cake form.

Lanolin has been employed in soaps as an emollient and it has been suggested in some patents for such use in transparent soaps. However, lanolin soaps and lanolin fatty acids have not previously been suggested for such purposes and the highly preferable incorporation of such materials in a kettle soap or other elevated temperature aqueous soap mix prior to drying has not been advocated or disclosed in the prior art. It is considered that the lanolin-based anti-crystallization material for the soap contributes usefully to the production of the transparent dried mix or chip and facilitates coalescence of such dried material into a transparent compacted product for subsequent extrusion as a transparent soap.

In accordance with the present invention a translucent soap cake comprises about 45 to 90% of mixed tallow and coconut oil soaps which are soaps of a base selected from the group consisting of lower alkanolamine and alkali metal hydroxide, and mixtures thereof, with from about 40 to 90% of the soap being a tallow soap and about 60 to 10% of the soap being a coconut oil soap, about 1 to 10% of a lanolin soap of a base selected from the group consisting of lower alkanolamine, alkali metal hydroxide, ammonium hydroxide, and mixtures thereof, or lanolin fatty acids or a mixture of such lanolin soap(s) and lanolin fatty acids, about 2 to 12%, of a polyol of 3 to 6 carbon atoms and 2 to 6 hydroxyl groups, and about 5 to 25% of water. Preferably, the invented soap cakes will be superfatted with lanolin fatty acids. While the invention best applies to products including the polyols, mentioned previously, in a broader sense it also relates to translucent soap cakes in which the lanolin soap(s), lanolin fatty acids or mixture thereof sufficiently promotes translucency of the soap cake so that the polyol, while useful, is not required, to make an acceptable final product. In other aspects of the invention translucent soap-synthetic organic detergent cakes are produced, using the lanolin soap and/or lanolin fatty acids to promote translucency, but other anti-crystallization additives may also be present. In other embodiments of the invention pearlescent particles, such as very finely divided mica plates, are incorporated with a translucent soap to make especially attractive products.

The invention also includes processes for making the described products, in which the various components of a translucent soap, except for lanolin soap, lanolin fatty acids (or lanolin or other derivative thereof) and mixtures thereof, are mixed together with such lanolin soap, lanolin fatty acids, etc., at an elevated temperature, and the mixture is dried to a moisture content in the range of 5 to 25%, after which the dried mixture may be worked, extruded, cut and pressed to finished translucent cake form. In such final processing good translucence is obtainable over a wider final working temperature range (primarily plodder working) than specified in the prior art, so temperature controls are not as critical. The described processes may also be applicable to making variegated soap cakes and soap-synthetic detergent combination bars. In another process the lanolin is saponified in the soap kettle with other soap fats and oils, which produces a more transparent soap and one which is harder, and easier to process. In a modification of the cake manufacturing process easier transfers of soap chips, cylinders, spaghetti, noodles and other soap forms results when lower moisture contents are used, with desired moisture in the final product being obtained by adding water in the amalgamator. Another aspect of this invention is an improved test for soap cake translucency.

The non-lanolin soaps that are utilized in making the products of this invention are what are normally referred to in the art as higher fatty acid soaps. Such may be made by the saponification of animal fats, greases and oils, and vegetable oils and fats, or may be made by the neutralization of fatty acids, which fatty acids may be derived from such animal and/or vegetable sources or may be synthesized. The fatty acids will normally be of essentially linear structure, with minor exceptions, and will be of about 8 to 22 carbon atoms, preferably 10 or 12 to 18 carbon atoms in the monobasic fatty acid chain.

Preferred soaps are those obtained by' saponification of a mixture of tallow (and/or hydrogenated tallow) and coconut oil (and/or hydrogenated coconut oil) or neutralization of the corresponding fatty acids, with the proportions of such being from about 40 to 90% of tallow and about 60 to 10% of coconut oil. The mixed soap resulting is one in which the tallow and coconut oil-derived soaps are present in about the same proportions as given for the starting tallow and oil. Preferably such proportions will be from 50 to 85% of tallow (and tallow soap) and 50 to 15% of coconut oil (and coconut oil soap), and more preferably such ratios will be 70 to 80% of tallow and 30 to 20% of coconut oil, e.g., 75% of tallow and 25% of coconut oil (and the corresponding soaps). Similar proportions apply when the corresponding fatty acids are used.

In the soap art it is recognized that hydrogenation of the soap precursor triglycerides and corresponding fatty acids helps to improve stability of the soap because of the removal of reactive double bonds. However, when making a translucent or transparent soap it can be desirable to have some unsaturation in the soap, which sometimes helps inhibit crystallization, which promotes opacity. Therefore, complete hydrogenation of the soap oils and fats is sometimes contraindicated. On the other hand sometimes soaps made from more saturated fatty acids are more transparent, in which case hydrogenated raw materials can be preferred. Thus, although stability of the end product against oxidation, decomposition, reaction with other soap composition components and development of rancidity may not be as good when unhydrogenated fatty materials are employed for the manufacture of the soap, sometimes it may be desirable to "trade off" such improvements in product characteristics for a variety of reasons, in which case hydrogenated materials may be omitted. When hydrogenated fats, oils and fatty acids (and soaps) are present, usually they will constitute only minor proportions of the soap materials, such as 5 to 40% or 15 to 25%.

Although mixtures of tallow and coconut oil or of the corresponding fatty acids (or stripped or specially cut fatty acids) are considered to be the most desirable materials for the production of soaps used to make the products of this invention, other sources of such lipophilic moieties may also be employed. For example, the tallow utilized may be from animals other than cattle, such as sheep, and mixed tallows and greases can be employed. The oil may be palm oil, palm kernel oil, babassu oil, soybean oil, cottonseed oil, rapeseed oil or other comparable vegetable product, and whale or fish oils and lards and various other animal fats and oils may be employed to produce soaps substantially like those from the coconut oil and tallow mentioned. In some cases, the oils will be hydrogenated or otherwise processed to modify their characteristics so as to make them more acceptable as soap sources. The fatty acids obtainable from such fats and oils may be substituted as sources of superfatting components and as reactants from which the soaps are made. In some cases synthetic fatty acids may also be employed, such as those made by the Fischer-Tropsch hydrogenation of carbon monoxide, or by oxidation of petroleum. To improve product transparency in some instances it can be desirable to utilize relatively small proportions of castor oil, hydrogenated castor oil and resin acids, such as tall oil acids, preferably as the soaps or neutralization products thereof.

The glycerides or fatty acids may be converted to soaps in a soap kettle or in other suitable neutralizing means, including thin film reactors, pipeline reactors and pump-type reactors, and mixed charges of fatty acids and glycerides may be used. Also, the soaps can be made, at least to a limited extent, in a mixing apparatus in which the other components of the transparent soap cake are blended together, usually at an elevated temperature, and prior to partial drying. The saponifying or neutralizing means will preferably be an alkali metal hydroxide or lower alkanolamine, although mixtures of such materials may also be employed in suitable circumstances. Of the alkali metal hydroxides sodium hydroxide is preferred but sometimes potassium hydroxide will be utilized, at least in part, because potassium soaps sometimes help to improve the transparency of the final soap cake. In appropriate circumstances other alkali metal compounds, of which the basic salts, e.g., sodium carbonate, potassium carbonate, can be most preferable, may be employed, as for the neutralization of free fatty acids. The lower alkanolamine will normally be one which has 2 or 3 carbon atoms per alkanol and 1 to 3 alkanols per molecule. Thus, among such compounds there are included, for example, triethanolamine, diisopropanolamine, isopropanolamine, di-n-propanolamine and triisopropanolamine. While the lower alkanolamines of 2 or 3 carbon atoms per alkanol are preferred, there may also be employed corresponding compounds wherein the alkanols are of 4 or 5 carbon atoms, but because soaps made from such bases may not be as useful in the present transparent products (and sometimes they may tend to have undesirable odors and other negative characteristics), if present at all they will usually constitute only relatively small proportions of the total soaps, e.g., 2 to 20%.

The lanolin soap and the lanolin fatty acids utilized in the practice of this invention are complex materials which have been described at length in the art. The carbon contents of such fatty acids range from about 11 (or slightly less) through 35 (or a little higher), with the lowest molecular weight acids being the most odorous and smelling "woolly" (so that the higher molecular weight acids are the most preferred for aesthetic reasons). Different cuts of lanolin fatty acids may be employed but it is usually preferable to use the uncut material, although sometimes more of a component acid or a related material may be added to improve transparency. For example, it may be preferred to add lower alkanolamine isostearate and/or lower alkylamine isostearate. The various lanolin fatty acids and the soaps made are or are of normal, iso- and anteiso- fatty acids and in some cases they are alpha-hydroxy-substituted. Some sterols may be present with the fatty acids but are not considered to be a part thereof. The fatty acids constitute about half of lanolin, with sterols, e.g., lanosterols and cholesterol, being esterifying moieties. Lanolin fatty acids and soaps which are made from them are transparency aiding components of soap cakes and also can be admixed with soap in an amalgamator and worked to clarity, as by milling and plodding. While employment of lanolin fatty acids or soaps made from them is highly preferred, nevertheless it is alsowithin a broader aspect of the present invention to use lanolin, lanolin fractions and lanolin derivatives, such as alkoxylated lanolin, for example, Solulan® 98, Polychols, Satexlans, as superfatting ingredients and also as transparency aiding materials when they are mixed with the tallow-coco soap at elevated temperature, after which the mix is partly dried and processed to soap cakes. Of course it is also preferred to blend the lanolin soap and/or lanolin acids with other soaps in the crutcher.

The lanolin soap may be made by reaction of the lanolin fatty acids with a base which is a lower alkanolamine, an alkali metal hydroxide, ammonium hydroxide or a lower alkylamine. The lower alkanolamine and alkali metal hydroxide (or basic alkali metal salt, which may be substituted for the alkali metal hydroxide) are the same as those previously described for saponification and/or neutralization of the tallow-coco triglycerides and/or fatty acids and the lower alkylamine is of 2 to 3 carbon atoms in the alkyl and of 1 to 3 alkyl groups per molecule. While neutralization may be effected in a soap kettle concurrently with the production of the tallow-coco soap, and often such processing results in distinct product advantages (more translucent product of better odor because of steam distillation off of the lower molecular weight and more malodorous fractions) it will often preferably (for convenience) be conducted in a separate reaction vessel, such as a crutcher or blender located immediately prior to the dryer for the mix. Also, neutralization of any added fatty acid, such as isostearic acid, will preferably be effected in the crutcher or similar blender, although such can also take place in the soap kettle or other saponification equipment.

The only other required component of all the products of this invention is water, although it may often be highly desirable to utilize additional crystallization inhibiting materials in addition to the lanolin soap, fatty acid or other lanolin component. The water will normally be that present in a kettle soap or other soap resulting from other manufacturing processes, such as neutralization of soap making fatty acids, but in some instances it can be added. Also, when combination bars or tablets containing synthetic organic detergent and soap are made, part of the water may be that present in a synthetic detergent slurry or solution that is employed. If water is to be added it will be preferred that it be deionized water or other water of low hardness, preferably less than 150 parts per million, as calcium carbonate, and more preferably less than 50 p.p.m. In some instances the moisture content of a kettle soap or a crutcher mix may be lowered, as to 25% to 28% for the kettle soap and a corresponding lowered range for the crutcher mix, and the mix may be dried to a lower moisture content, e.g., 11 to 15%, to improve transfer ease (decrease any stickiness). Then, the moisture content may be increased about 1 to 5% by adding water to the amalgamator, and about 1 to 2% may be lost in working (mostly in milling), to produce a cake of desired moisture content (14 to 18%), which is acceptably translucent.

The most preferred of the crystallization inhibitors which are preferably present in the products of this invention, and which, in combination with the lanolin material, help to produce translucent and even transparent cake products, are the polyols. Such materials, which contain 2 or more hydroxyl groups per mol, are preferably of 3 to 6 carbon atoms and 2 to 6 hydroxyl groups per mol. While sorbitol and glycerol are preferred polyols of this group other sugar alcohols, such as maltitol and mannitol, and sugars, such as glucose and fructose, may also be employed. Although technically sucrose is outside the description of the preferred polyols, it may be used as a supplementing anti-crystallization additive, preferably with one or more of the preferred polyols. Additionally, propylene glycol, various polyethylene glycols, hydrogenated castor oil, resins, and other materials known to have the desirable anti-crystallization activity may be employed.

While the use of volatile materials to promote translucency is not to be excluded from the present compositions it is a distinct advantage of this invention that such materials are not required and preferably are not employed.

Although isostearic acid is a constituent of lanolin and therefore is present in the lanolin soap (or the isostearic acid is present in the lanolin fatty acid) it has been noted that good translucency of the soap tablets is still obtainable when additional lower alkanolamine isostearate is present in the composition, to which it may be added to improve handling of the lanolin soap. The lower alkanolamine is of the type previously described and the isostearate may be made by neutralization of isostearic acid by the alkanolamine, using conventional methods. It may be pure or it may include some other analogous and homologous soaps, too. Preferably the isostearate soap is more than 80% isostearate, such as isopropanolamine isostearate or triethanolamine isostearate, or a mixture thereof.

If combination soap-synthetic organic detergent bars or cakes are to be made, the synthetic organic detergent will preferably be an anionic detergent, although nonionic detergents and amphoteric detergents may also be employed, and such different types of detergents may be employed alone or in mixture. Preferably the anionic detergents will be water soluble sulfates or sulfonates having lipophilic moieties which include straight chain or substantially straight chain alkyl groups having 10 to 20 carbon atoms, preferably 12 to 18 carbon atoms. The sulf(on)ates may include as the cation thereof sodium, potassium, lower alkylamine, lower alkanolamine, ammonium or other suitable solubilizing metal or radical. Among the preferred anionic detergents are the paraffin sulfonates, olefin sulfonates, monoglyceride sulfates, higher fatty alcohol sulfates, higher fatty alcohol polyethoxy sulfates, sulfosuccinates and sarcosides, e.g., sodium paraffin sulfonate wherein the paraffin is of 14 to 16 carbon atoms, sodium coconut oil monoglyceride sulfate, sodium lauryl sulfate, sodium triethoxy lauryl sulfate, and potassium N-lauroyl sarcoside. The nonionic detergents will be normally solid (at room temperature) compounds, such as condensation products of higher fatty alcohols of 10 to 20 carbon atoms with ethylene oxide wherein the molar ratio of ethylene oxide to fatty alcohol is from 6 to 20, preferably 12 to 16, polyethylene glycol esters corresponding to such ethers, and block copolymers of ethylene oxide and propylene oxide, (Pluronics®). The amphoteric materials that may be employed include the aminopropionates, iminodipropionates and imidazolinium betaines, of which Deriphat® 151, a sodium N-coco-betaaminopropionate (manufactured by General Mills, Inc.), is an example. Other such anionic, nonionic and amphoteric detergents are described in McCutcheon's *Detergents and Emulsifiers*, 1973 Annual, and in *Surface Active Agents*, Vol. II, by Schwartz, Perry and Berch (Interscience Publishers, 1958).

Various adjuvant materials may be present in the soap cakes of this invention, providing that they do not objectionably interfere with the translucency or transparency of the desired product. Usually, such adjuvants will be present in relatively small proportions, such as up to no more than 2, 3, or 5% (total), and 1 or 2% (individual). Among such are perfumes, dyes, pigments (usually for an opaque portion of a variegated or striated soap), optical brighteners, additional superfatting agents, bactericides, antibacterial materials, (incorporated in a manner which does not cause soap crystallization), antioxidants and foam enhancers, e.g., lauric myristic diethanolamide. Generally, inorganic salts and fillers will be avoided to the extent possible but small quantities of these may sometimes be present. However, finely divided mica and other suitable pearlescing agents (including crushed shells and suitable shiny minerals) of desired size may be mixed with the other soap components or parts thereof to give the final tablet an opalescent or plearlescent appearance which is especially attractive because the transparent or translucent soap allows viewing of the mica particles whereas these are obscured by opaque soaps. The preferred mica particles are less than No. 100, preferably less than No. 200 and more preferably less than No. 325, U.S. Sieve Series, and will often be about 2 to 10 microns, average equivalent spherical diameter. A suitable such product is a muscovite mica sold under the name Mearlmica MMMA by The Mearl Corporation, New York, N.Y. The mica or other such agent is preferably dispersed in a liquid, e.g., glycerol, at a 5 to 20% concentration, and is added in the amalgamator to make a product containing 0.05 to 0.5% mica. It may also be added to one soap only, used to make a variegated or striated final soap cake.

The perfume employed will normally include a transparent essential oil and an intensifying agent, and often will also incorporate a synthetic odorant or extender. These materials are well known in the art and need not be recited at length herein, except for the giving of illustrative examples. Thus, among the essential oils and compounds found in such oils that are useful may be mentioned geraniol, citronellol, ylang-ylang, sandalwood, Peruvian balsam, lavender, bergamot, lemongrass, irone, alpha-pinene, isoeugenol, heliotropin, vanillin and coumarin. Musk ambrette is a useful intensifying agent and diphenyl ether, phenyl ether alcohol, benzyl alcohol, benzyl acetate, and benzaldehyde are examplary of synthetics that may be included in the perfumes.

The proportions of the various components of the translucent soap cakes of this invention will be chosen to promote such translucency or transparency and often the proportions will be such as to give the resulting soap cake other desirable characteristics too, such as sheen or gloss, hardness, lathering power, low sloughing, and desired solubility and cleaning characteristics. Generally, the soap cake will comprise from 45 to 95% of soap (excluding lanolin soap and any added isostearate soap), 1 to 15% of lanolin soap or lanolin fatty acids or a mixture of such lanolin soap(s) and lanolin fatty acids, and about 5 to 25% of water. The percentages of lanolin soap (and/or lanolin fatty acids) and water will both be chosen to promote translucency. When a polyol of the type described for promoting translucency is also present, as it is in preferred products, the proportion of soap (mixed tallow and coconut oil soaps) will be from 45 to 90%, preferably 60 to 84% and more preferably 68 to 79%, e.g., about 76%, the lanolin soap (and/or lanolin fatty acids) will be from about 1 to 15%, preferably 1 to 10%, more preferably 2 to 8% or 2 to 4%, e.g., about 3%, the polyol will be about 2 to 12%, preferably 4 to 10%, more preferably 5 to 7%, e.g., about 6%, and the water content will be about 5 to 25%, preferably 9 to 20%, more preferably 14 to 18%, e.g., about 15 or 16%. In such soap cakes the tallow-coconut oil soap will usually contain from about 40 to 90% of tallow soap and 60 to 10% of coconut oil soap, preferably 50 to 85% of tallow soap and 50 to 15% of coconut oil soap, and more preferably 70 to 80% of tallow soap and 30 to 20% of coconut oil soap, e.g., about 75% of tallow soap and about 25% of coconut oil soap. Of course, as was previously mentioned, equivalents of such soaps may be substituted so long as the final product is of approximately the same end composition. When lanolin fatty acids are present they act as superfatting agents, giving the soap cake very desirable skin softening properties, in addition to promoting transparency, and improving lathering. When such superfatting is present it will be 0.1 to 5 or 10%, preferably 0.5 to 3 or 5%, e.g., usually 2 or 3% of the soap cake.

When added lower alkanolamine isostearate soap is present in the translucent tablet, generally only so much will be employed as will significantly improve processing. Thus, from 0.5 to 4%, preferably 1 to 3% and more preferably about 2% will often be present. If anti-crystallization additives other than those for which proportions have already been mentioned are present they will usually not exceed 5% of the tablet and normally the total proportion of anticrystallization compounds, including lanolin soap, lanolin fatty acids, polyol, lower alkanolamine isostearate and others, will not exceed 25%, preferably being no more than 20% and more preferably being no more than about 15% of the product.

When variegated tablets are made, including at least some translucent soap, they will generally comprise from 1 to 20 parts of such translucent soap and 20 to 1 parts of a contrasting translucent soap (preferably of the same type) or an opaque soap or a mixture of such translucent soap and opaque soap. Thus, tablets can be made which are mostly translucent or mostly opaque. In variegated products the proportions of the mentioned parts are preferably 1 to 5 to 5 to 1 and more preferably are 1 to 3 to 3 to 1. The different component soaps of the variegated soaps will preferably be of the same formulas, insofar as is possible, so that the only difference between them will be in one being translucent or transparent and the other being differently colored (if also translucent or transparent) and/or opaque. Thus, it is considered desirable for the lanolin soap or lanolin fatty acids to be present in the opaque composition as well as in the translucent compositions. It is considered that if significant differences in formulations between component soaps of the variegated soaps exist the soaps may not cohere satisfactorily during manufacture and use. It is clear that variegated soaps of this invention may include transparent soaps of different colors, transparent and translucent soaps of the same or different colors, transparent and opaque soaps of the same or different colors, translucent and opaque soaps of the same or different colors, and transparent, translucent and opaque soaps of the same or different colors. Additionally some of the mentioned soap parts may be made pearlescent, as previously described. Thus, many combinations of aesthetic effects are producible. The variegated and striated products referred to above are disclosed herein but are not claimed because they are presently considered to be the inventions of the present inventor and another, and are expected to be the subjects of another patent application.

As used in this specification, and particularly in the above paragraph, the meanings of "transparent" and "translucent" are those generally employed and are in accordance with usual dictionary definitions. Thus, a transparent soap is one that, like glass, allows the ready viewing of objects behind it. A translucent soap is one which allows light to pass through it but the light may be so scattered, as by a very small proportion of crystals or insolubles that it will not be possible to clearly identify objects behind the translucent soap. Of course, even "transparent" objects, such as glass, can prevent seeing through them if they are thick enough. For the purpose of this specification, it will be considered that the soap section tested for transparency or translucency is approximately 6.4 mm thick (¼ inch). Thus, if one is able to read 14 point bold face type through a ¼ inch or 6.4 mm. thickness of soap, the soap qualifies as transparent. If one can see light through such thickness but can't read the type the soap is only translucent. Of course, all transparent soaps also qualify as translucent (considering translucent as generic). Other tests for transparency and translucency, including the translucency voltage test mentioned in U.S. Pat. No. 2,970,116, may also be employed.

However, the best test is one invented by the present inventor in which a translucent bar can be tested for translucency easily, reproducibly and without any need to cut a soap cake to a lesser thickness. All that is needed is a light source, such as a flashlight, and a photographic light meter. The flashlight is turned on, the soap cake, without modification, is placed against the light and the light meter is placed against the other face of the cake. A meter reading directly measures translucency. Clearly, comparative readings against a control allow calibration of any meter and light. The equipment is readily available, inexpensive, easy to use, readily portable, and familiar to all. The readings are reproducible and accurate. It is considered that this test, named the Colgate-Joshi Translucency Test, may well become the standard in this field in the near future.

Combination soap-synthetic organic detergent cakes which are translucent may be made when 40 to 90% of soap is mixed with 5 to 55% of normally solid synthetic organic detergent of the type(s) previously mentioned. Preferably, such ratios will be 70 to 90% of soap and 10 to 25% of synthetic organic detergent. The percentages given are on a final bar basis, which accounts for the fact that they do not add up to 100%. Of the synthetic compounds, the paraffin sulfonates, higher alcohol sulfates and monoglyceride sulfates are preferred. Variegated soap-synthetic detergent cakes may be made in the same general manner as previously described for variegated soaps.

The various described tablets, whether translucent or transparent, pearlescent, superfatted or not, variegated, all soap or with both soap and synthetic detergent in the composition, may be made using various types of apparatuses and processing steps but preferred processes all include blending the soap (and synthetic organic detergent, if a combination bar is to be made), lanolin soap (or lanolin fatty acids, lanolin or suitable derivative thereof) and water (usually present with the soap and/or synthetic organic detergent) at an elevated temperature, and partially drying such mixture. As previously mentioned, the lanolin soap may be made with the base soap in a soap kettle or other saponifier. Subsequently, the dried mix may be compounded with perfume, colorant, water and other minor adjuvants which do not significantly adversely affect the transparency or translucency of the product, worked, as by milling on a five-roll soap mill, plodded, and pressed to shape. In preferred embodiments of the invention polyol anticrystallization compound may be mixed with the soap, lanolin soap and water, optionally with supplementary property enhancing agents, such as diethanolamine isostearate, and the entire mix may be dried. Also, some saponification of animal and vegetable derived fatty acids and of lanolin and isostearic acid may take place in a crutcher or other mixer, usually when lanolin or lanolin fatty acids are being saponified or neutralized, or when amine or alkanolamine neutralization of free fatty acid is being effected. Of course, an excess of lanolin or other saponifiable or neutralizable lipophile may be employed so that part of it remains as superfatting agent in the soap cake.

The various materials being employed are commercially available for the most part, although it is usually highly desirable, almost a practical necessity, for means for manufacturing large quantities of the main soap base to be on premises. Thus, for example, lanolin fatty acids, preferably the entire fatty acid cut from lanolin, except possibly for the lowest and highest fatty acids, may be purchased from Amerchol Corporation, Croda Corporation or Emery Industries, Inc., as may be various derivatives of lanolin, and such may be converted to soaps,as described, and by equivalent methods. Isostearic acid is also commercially available, as are the various polyols mentioned. The mixed animal fat and vegetable oil soaps may be made by the full boiled kettle process or by any of various other processes that have been successfully employed for the manufacture of soaps. For example, continuous neutralization of fatty acids, continuous saponification of fat-oil mixtures, sonic saponification methods, enzyme processes, multistage saponifications and neutralizations, and in-line and pump saponifications and neutralizations may be employed, so long as they produce a satisfactory end product. In some instances, the end product will contain glycerol from the saponification of glycerides (usually triglycerides) and such may be left in the soap to act as a crystallization inhibitor, in conjunction with the lanolin soap, lanolin fatty acids, etc.

In the broadest aspect of the present process translucent soap cakes are made by mixing together, at an elevated temperature, components of a translucent soap, except for the lanolin type crystallization inhibitor, such inhibitor, and sufficient water, usually with the soap, usually from 20 to 45%, preferably 25 to 40%, to maintain the soap and the mix desirably fluid, after which the mixture is partially dried to a moisture content in the range of 5 to 25%, at which moisture content a subsequently worked, extruded and pressed cake of such composition will be translucent, and the mix is worked, extruded and pressed into finished translucent soap cakes, usually after cutting of the extruded bar into blanks for pressing.

The mixing may take place at a temperature in the range of 40° to 160° C. but in preferred aspects of the process the temperature is in the range of 65° to 95° C., more preferably 70° to 90° C. and most preferably 80° to 90° C. The drying occurs at a temperature in the range of 40° to 160° C., preferably 40° to 60° C., such as 45° to 50° C., for an open belt or tunnel dryer, in which the mix is converted to ribbon form on a chill roll and is subsequently dried in a hot air dryer, with higher temperatures, usually from 70° C. to 160° C., often being used for various other types of dryers, including atmospheric plate heat exchangers (APV), thin film evaporators (Turbafilm evaporators) which operate at room temperature, and superheat and flash evaporators, such as the Mazzoni evaporators, which operate under vacuum. Of course, other types of dryers may also be used so long as they do not cause objectionable crystallization and resulting opacity of the mix or so long as they do not cause such crystallization which is not reversible in further processing. Usually it has been noted that rapid drying favors translucency of the product, as opposed to opacity which can more readily result when drying is slower, which condition favors crystallization.

Normally, before drying, various components of the mix to be dried are blended together, as previously suggested, and during such blending, as when a crutcher or other suitable mixer is employed, lanolin fatty acids may be converted to lanolin soap to the extent desired, or other such neutralization or saponification reactions may be undertaken. Such mixing may be in a portion of equipment intended primarily for drying, as in an upstream in-line pipe mixer, such as one of the Kenics or equivalent type. However, it is preferred, for more readily and accurately controllable operations, to utilize a soap crutcher, from which the mix is pumped to the dryer. While crutchers normally operate batchwise, two or more of them may be used alternately to maintain a continuous feed to the dryer. Preferably, the drying operation will be continuous so that a steady feed of chips will be available for processing into bars and cakes. Still, it is within the invention to temporarily store such chips in bins before use. Amalgamators or other suitable mixers, in which the chips are combined with perfume and other additives which do not adversely affect translucency, are normally used in batch operations but continuous blending is also within the invention.

In the process for manufacturing the translucent soap cakes the mix to be dried will usually contain about 45 to 95 parts of soap of a type previously described, about 1 to 10 parts of lanolin soap, lanolin fatty acids or other lanolin material, about 2 to 12 parts of polyol and about 25 to 50 parts of water, and the drying will be done to a moisture content in the range of 5 to 25%. Of course other minor components may also be present in the mix but they will rarely exceed 15 or 20 parts. Preferred proportions of the components are 60 to 84 parts of soap, 2 to 8 parts of lanolin soap or other lanolin material, 4 to 10 parts of polyol, preferably sorbitol, glycerol and/or maltitol, and 30 to 45 parts of water, and drying will be to a moisture content in the range of 10 to 20%. In most preferable processes 68 to 79 parts of soap, 2 to 4 parts of lanolin soap, 5 to 7 parts of sorbitol and 30 to 45 parts of water will be present in the mix and the drying will be to a final moisture content such that the moisture in the soap cakes is from 14 to 18%, (with the moisture content of the chip often being about 0 or 1 to 3% more). Drying times vary, usually being from as little as few seconds to as much as an hour, with typical drying times for flash processes being from 1 to 10 seconds and for belt drying being from 2 to 20 minutes. As mentioned previously shorter drying times are usually preferable.

After the completion of drying to the desired moisture content at which the dried material is translucent or capable of being converted to translucent form with a reasonable amount of working, the partially dried chip is mixed with perfume and any other desired adjuvants which will not opacify the mix. Such mixing preferably takes place in a conventional soap amalgamator, such as one equipped with a sigma-shaped blade, but various other types of mixers and blenders may also be employed. Among the adjuvants that may be blended with the partially dried soap (or soap-synthetic detergent chip, when combination bars are to be produced), many of which have been mentioned previously, one may utilize non-opacifying antibacterial materials. However, most of the more effective antibacterial materials suitable for use in soaps are solids under normal conditions and accordingly, if blended in powder form with the soap chip in an amalgamator, could cause the product to appear opaque. Therefore, such antibacterial materials may first be dissolved in a lipophilic substance, such as perfume, prior to mixing the perfume with the soap chip. Such process is taught in U.S. Pat. No. 3,969,259. Additionally, as is taught in U.S. patent application Ser. No. 06/414,445, for Process for Manufacture of Antibacterial Transparent Soap Bar, filed the same day as the present application by the present inventor and Peter A. Divone, antibacterial (bactericidal or bacteriostatic), compounds, such as 2,4,4'-trichloro-2'-hydroxy diphenyl ether, which are stable at the elevated temperatures of the mixing (crutching) and drying operations, may be incorporated in the soap at any convenient stage before drying, such as in the soap kettle or the crutcher (preferably the latter). It has also been found that with the present compositions water may be added in the amalgamator without opacifying the end product.

After amalgamating or equivalent mixing or blending, the perfumed mix may then be plodded or otherwise compacted, as by extrusion, to bar form and may subsequently be converted to a cake or tablet by cutting and/or pressing. While plodding without preliminary milling is feasible and can produce a transparent soap, it is normally preferable for the amalgamated mixture to be milled or equivalently worked before plodding. Such working may be such as to raise the temperature of the milled material to or maintain it at a desired level for optimum translucency. It has been found that such temperature will often be in the range of about 30° to 52° C. preferably 35° to 45° C., e.g., 39° to 43° C., but the ranges can differ for different soaps and different soap-synthetic detergent mixtures. Normally it will be desirable for both milling and plodding (and other working) temperatures to be held within such ranges. During milling the chip thickness will normally be kept within the range of 0.1 mm. to 0.8 mm., preferably being from 0.1 mm. to 0.4 mm., with the smaller ribbon thicknesses being those removed from the mill. Although a three-roll mill may be employed it is highly preferred to use one or two five-roll mills (with roll clearances being adjustable). If desired, the chip may be put through the mill twice or more, or a plurality of mills may be utilized, with the discharge from one being the feed to another.

From the mill or other working device, if employed, the chip is fed to a vacuum plodder or equivalent extruder, preferably a dual barrel plodder capable of producing high extrusion pressures. The plodder is equipped with a cooling jacket to hold the temperature of the soap within the working ranges previously recited. Air, which enters the plodder with the chip feed, is removed in a vacuum chamber and the bar extruded is clear in appearance (although in some cases the clarity may not be as great as after a period of storage of the final pressed cakes). The compacted and additionally worked plodder material is extruded as a plodder bar, which is automatically cut to lengths and pressed to shape by appropriate dies. The transparent or translucent soap cakes made are then automatically wrapped, cased and sent to storage, prior to distribution. Any waste from the pressing operation may be re-plodded with other feed to the plodder but such recycling is best effected when variegated or opalescent products are being made (in which cases no irregularities due to the different feeds are discernible).

When variegated soaps or other mixed color or mixed character soaps (or soap-detergent cakes) are to be produced, two different charges of soap of different colors or other identifiable characteristics are fed to the vacuum plodder in desired proportions, or a colorant is added to the plodder with the soap charge so that the color thereof will be unevenly distributed throughout the soap. A Trafilino variegator may be employed to feed the different soap cylinders, and/or a glycerol suspension of mica powder and dye may be dripped into the bottom barrel of the plodder or the plodder head to make an opalescently variegated or striated soap. The variegated plodder bar resulting may be pressed to different patterns, as desired, depending on which face thereof is most desirably distorted by the pressing operation. For example, different patterns will result if the plodder bar is pressed in a die box between opposihg dies which are in contact with the bar ends, as compared to bars made when the dies contact the bar sides or when the blank is angled.

The following examples illustrate the invention but do not limit it. Unless otherwise indicated all parts are by weight and all temperatures are in °C.

EXAMPLE 1

| Components | Percent |
|---|---|
| Sodium coco-tallow soap (25:75 coco:tallow) | 74.2 |
| Triethanolamine soap of lanolin fatty acids | 4.0 |
| Sorbitol | 6.0 |
| Moisture | 15.0 |
| Bactericide | 0.3 |
| Perfume | 0.5 |
| | 100.00 |

A translucent soap bar of the above formula is made by dissolving the bactericide in lanolin fatty acids, from which the lanolin soap is made, after which the lanolin fatty acids are neutralized with triethanolamine and are mixed with kettle soap and sorbitol in a soap crutcher. The kettle soap and the crutcher mix are at a temperature of about 70° C. and the kettle soap moisture content is about 28.5%. The triethanolamine and lanolin fatty acids are reacted in approximately stoichiometric proportions so that no excess of triethanolamine is present in the crutcher mix and little if any free lanolin fatty acids remain therein. After mixing for approximately five minutes after addition of all the components the crutcher mix is pumped to a continuous Mazzoni flash dryer, wherein the mix, at a temperature of about 70° C., is flashed into a vacuum chamber so that the moisture content thereof is reduced to about 16 or 17%. The dried mix is removed from the Mazzoni apparatus and is blended with the formula proportion of perfume, after which the amalgamated mixture is milled, using a five-roll soap mill with roll clearances diminishing from 0.5 to 0.2 mm. The mill temperature is regulated so that the soap ribbons produced are at a temperature of about 42° C. The mill ribbons, which appear somewhat translucent, are then plodded in a dual barrel vacuum plodder, with the soap temperature being held at about 42° C., and are extruded as a continuous bar, which is cut to blank lengths, stamped to final form, wrapped, cased, and sent to storage.

The soap cakes made are transparent, so that 14-point type can be read through a 6 mm. thickness thereof. They are of satisfactory lathering and foaming properties, are good cleansers, are of attractive appearance, with good sheen or gloss, are hard, do not crack during use, and maintain their transparency during use. Tests of the effectiveness of the bactericide, which is preferably 2,4,4'-trichloro-2'-hydroxy diphenyl ether taught in U.S. patent application Ser. No. 06/414,445, filed by the present inventor and Peter A. Divone concurrently with this application, show that it was not inactivated by the manufacturing process. The soap cakes made maintain their transparency during storage, and in fact, appear to become even more transparent after storage for about a month.

That the aged soap cakes are as transparent as or more transparent than those initially made and are as transparent as or more transparent than acceptably transparent commercial products of this general type is readily established by use of the Colgate-Joshi translucency test method. Following such method, shortly after manufacture of the transparent soap cakes such a cake is placed so that one of its major faces (the cake is in the rounded corner regularly parallelepipedal form of a typical soap bar) is against a flashlight (Eveready two C-cell type), the flashlight is switched on and a photographic light meter (Kodak), having a needle indicator which registers on a marked background scale and having a light receiving area less than that of an opposing major face of the soap cake, is placed in contact with such surface so that it receives no light other than that passing through the soap cake. The needle reading is noted and recorded. In a similar manner a light transmission reading is taken of the control bar of a commercial formula, such as that sold under the trademark Nutrogena, of about the same thickness. Similarly, after a month's aging the same test is repeated with respect to the experimental bar. It is found that the light transmission is about the same as or greater for the experimental bar than for the commercial product and after aging a further slight improvement is noted in such transmission, indicating improved translucency or transparency.

In the above formula the coco-tallow soap can be changed to include hydrogenated coconut oil soap and hydrogenated tallow soap, both to the extent of about ¼ of the amounts of such soaps present, the lanolin fatty acid soap can be made by neutralization with isopropanolamine, the sorbitol may be replaced by glycerol, maltitol and/or mannitol, in various mixtures, e.g., 2:2:2, the perfume may be changed and the bactericide may be omitted, and the result will still be a satisfactory translucent soap cake of the desired properties previously mentioned in this example. Further changes in the formulation include modifying the ratios of the coconut oil and tallow to 50:50, 40:60 and 20:80 and in all such cases satisfactory products are obtainable, although those higher in coconut oil soap content may be less translucent. Even when such soaps are completely hydrogenated useful products can be made, although processing conditions control may be more critical to avoid processing difficulties and undesirable end product characteristics. When the proportions of the various components are changed to ±10%, ±20% and ±25%, while maintaining them within the ranges disclosed in the preceding specification, useful translucent products are also made.

The processing described may also be modified so that the neutralization of the lanolin fatty acids with triethanolamine takes place in a preliminary reactor, from which the lanolin soap is pumped to the soap crutcher, or initial mixing may be in the crutcher. Temperatures and moisture contents may be changed within the ranges given in the specification and instead of drying the crutcher mix in a flash dryer, a tunnel dryer may be employed at a lower temperature, e.g., one in the range of 40° to 50° C.

EXAMPLE 2

| | Percent |
|---|---|
| Sodium coco-tallow soap (25:75 coco:tallow) | 73.0 |
| Lanolin fatty acids (uncut) | 3.0 |
| Sorbitol (added as 70% aqueous solution) | 6.0 |
| Stannic chloride (added as 50% aqueous solution) | 0.2 |
| Sodium ethylene diamine tetraacetate (added as 20% aqueous solution) | 0.10 |
| Dye (added as dilute aqueous solution) | 0.2 |
| Perfume | 1.5 |
| Moisture | 16.0 |
| | 100.00 |

A translucent soap bar of the above formula is made substantially in the manner described in Example 1. The lanolin fatty acids are admixed with the 71.5% solids content kettle soap at the described elevated temperature, which may be as high as 80° C., after which the other components, except the perfume, are also admixed, and the product is dried in a Mazzoni flash dryer or a tunnel dryer, followed by amalgamation with perfume and any other temperature sensitive constituents of the formula (stannic chloride, sodium EDTA and colorant may be added in the amalgamator instead of the crutcher). The final translucent soap cakes made are of the satisfactory properties described for the product of Example 1 and it even appears that translucency has been improved, which might be due to the replacement of the lanolin soap with lanolin fatty acids.

In other experiments the proportion of lanolin fatty acids is changed to 1%, 2%, 4% and 8%, and bar characteristics are noted. Improved translucency is observable when the lanolin content is increased from 1 to 3% but the 4% lanolin fatty acids formulation does not appear to be very noticeably clearer than the 3% formulation. Further doubling of the lanolin fatty acids content (in all such cases the other variable changed is the sodium coco-tallow soap content) does not have much effect on translucency, although it does improve the emollient action of the soap significantly.

When the 3% lanolin fatty acids formula given is further modified by replacing 0.7% of the coco-tallow soap with finely divided mica so as to make a pearlescent product, with the mica particles showing through the translucent soap, at least near the surface of the cake, an improved soap cake of distinctive and attractive pearlescent appearance results. The finely divided mica employed is that sold under the trademark MEARLMICA MMMA. It is a nearly white, water-ground muscovite mica of particle sizes under No. 325, U.S. Sieve Series, with most of the platelets thereof in the range of 2 to 40 microns in their longest dimension and being of about 6 to 10 microns average equivalent spherical diameter. Such mica powder has a bulk density of about 150 grams/liter and a surface area of about 3 square meters per gram.

Combination soap-synthetic organic detergent products of similar properties may be made by replacing about 15%, on a final bar basis, of the sodium coco-tallow soap with a suitable synthetic organic detergent, e.g., sodium triethoxylauryl sulfate, sodium N-lauroyl sarcoside, sodium hydrogenated coconut oil fatty acids monoglyceride sulfate, sodium lauryl sulfate, Pluronic F-68, Neodol 25-6.5 and/or Deriphat 151. Such replacement may be made in both the non-pearlescent and pearlescent formulas. If the products are not sufficiently translucent in particular formulas, additional anti-crystallization components may be employed, e.g., propylene glycol, or increased proportions of such components may be used, e.g., 5% of lanolin fatty acid and 8% of sorbitol or sorbitol-glycerol mixtures. The products, like those previously described, are satisfactory personal size and bath size toilet soaps, possess excellent emollient characteristics, lather profusely and are attractive in appearance.

The presence of the mica or other pearlescent powder (ground sea shells, bismuth chloride and various other minerals can also be substituted for it, at least in part) helps to make the partially dried chips to be conveyed to the mixer before the mill and/or plodder somewhat easier to handle with automatic conveying equipment, in which sticky chips can cause blockages and other problems. Such problems can be accentuated when the moisture content is near the upper limit of the range given, and when comparatively large proportions of lanolin, lanolin fatty acids, lanolin soap and/or lanolin derivatives and polyols are also present in the formulas. Another way to improve processability is to keep the moisture content of the partially dried chip or Mazzoni product relatively low, in the range of 11 to 15%, preferably in the lower portion of such range, transport such material by automatic conveying equipment to an amalgamator or a suitable mixer, add back sufficient moisture, e.g., 1 to 5%, allowing for any moisture loss in the working stages, and mill and/or plod to the desired bar form, which is then converted to a pressed cake of the desired moisture, e.g., 14 to 18%. To obtain the desired low moisture of the partially dried mix one may also control the moisture content of the kettle soap or other basic soap mixture so that it will be lower than the standard 28.5% moisture content mentioned in Example 1 (also that of the soap utilized in the present example).

EXAMPLE 3

A kettle soap is made from a charge of lipophiles consisting of 21% of coconut oil, 75% of tallow and 4% of lanolin, with the soap being boiled with sufficient caustic solution (50% NaOH) and brine to completely saponify the oils mentioned, leaving a free alkali content of 0.1% (as $Na_2O$), 0.7% of sodium chloride and 2% of glycerine in the neat soap (on a solids basis). This kettle soap is then utilized as a charge to a soap crutcher, with sufficient sorbitol being added so that the soap made from such mixture by partially drying it contains about 15% of moisture, 6% of sorbitol, 1.6% of glycerine, 0.5% of sodium chloride, 3% of lanolin soap and the balance, 73.9%, of a coco:tallow soap of about 22:78 coco:tallow ratio and some lanolin alcohols.

The soap cake made is satisfactorily translucent and is otherwise an excellent toilet soap bar. It appears to be harder and slightly more translucent than comparable cakes made by the addition of lanolin, lanolin fatty acids or lanolin derivative and it has been theorized that such is due to the fact that the anti-crystallizing lanolin soap was present with the coco:tallow soap when it was being made and therefore could inhibit crystallization and the production of crystallization "seeds" at such stage, as well as during subsequent workings. When desired, additional lanolin soap and/or lanolin fatty acids, e.g., 3% of lanolin fatty acids, are added in the crutcher.

The soap made has less of a characteristic woolly or lanolin odor than a comparable product made by addition of all the lanolin soap in the crutcher. It is considered that at least in part this is due to the continuous steam distillation effected by the use of live steam for mixing the reactants in the soap kettle, which distillation removes some of the more volatile and more odorous lanolin constituents.

EXAMPLE 4

A crutcher mix is made of 70.75 parts of an anhydrous 37.5:62.5 coco:tallow sodium soap accompanied by a moisture content of about 28% of the kettle soap, 6 parts of sorbitol (added as a 70% aqueous solution), 0.75 part of propylene glycol, 4 parts of triethanolamine soap of lanolin fatty acids and 1 part of triethanolamine isostearate. The triethanolamine soaps are made by prereacting 3 parts of lanolin fatty acids and 0.75 part of isostearic acid with 1.25 parts of triethanolamine, and the reaction product, which is completely saponified, is found to be of better handling characteristics in the translucent soap formula than is a similar product without the isostearate (without which the soap may be too hard). After mixing of the various components of the crutcher mix it is dried in a Proctor & Schwartz hot air, moving wire belt tunnel dryer, after being converted to ribbons on a chill roll. The dryer, which operates using hot air at a temperature of about 45° to 50° C., dries the chip to a moisture content of about 18%. Such chip is then mixed with about 1% of perfume (floral type) in an amalgamator, without the addition of water, and is made into a final toilet soap cake of good translucence by the method described in Example 1. The product is a good translucent soap, of as good transparency as commercial "transparent soaps", of excellent lathering power, low dry cracking tendencies, good emolliency and stable transparency. It is an attractive product but its appearance and other properties can be further improved by addition of colorant, stabilizer, bactericide, etc., in the amalgamator, with perfume.

In variations of this experiment isopropanolamine and other lower alkanolamines are substituted for the triethanolamine and similarly useful translucent soap cakes are obtained. In other variations of the formula, the sodium soap may be at least partially, e.g., 10%, replaced with potassium soaps and/or with other lower alkanolamine or lower alkylamine soaps, such as diethanolamine soaps of the same fatty acid composition and triethylamine soaps. Similarly, the lanolin soaps made for addition to the kettle soaps or base soaps may be alkali metal hydroxide soaps, such as sodium or potassium soaps, or may be soaps of ammonium hydroxide, and useful translucent toilet soaps are obtained.

When the coco tallow ratio of the soap of this example is changed to 25:75 or 20:80, improved translucence is the result, apparently due to better translucency being obtainable when higher proportions of tallow soap are present in the soap base.

EXAMPLE 5

| | Percent |
|---|---|
| Sodium coco tallow soap (37.5:62.5 coco:tallow) | 71.5 |
| Lanolin fatty acids | 3 |
| Sorbitol | 4 |
| Glycerol | 2 |
| Moisture | 18 |
| Perfume | 1.5 |
| | 100.00 |

A translucent soap bar of the above formula is made by the method of Example 1. Its characteristics are those of products of the preceding examples. It is an acceptable and satisfactory translucent soap of excellent emollient characteristics.

The above formula may be varied by including small percentages, from 0.1 to 1.5%, of fluorescent brightener, and similar proportions of suitable dyes, bactericides and antioxidants in the crutcher mix at the expense of the base soap, and a good translucent product is still obtained. Furthermore, when from 0.3 to 0.8% of pearlescent mica of the type previously described is also included in the crutcher (or amalgamator), preferably dispersed in the formula proportion of glycerine, an attractive pearlescent product is obtained. In another variation, in accordance with another invention previously referred to in this specification, when a Trafilino vacuum plodder mechanism is utilized a variegated product may be produced, which can be variegated and pearlescent or striated, too.

The invention has been described with respect to various illustrations and embodiments thereof but it is not to be considered as limited to these because it is evident that one of skill in the art with the present specification before him will be able to utilize substitutes and equivalents without departing from the invention.

What is claimed is:

1. A translucent soap cake which comprises about 45 to 90% of mixed tallow and coconut oil soaps which are soaps of a base selected from the group consisting of lower alkanolamine and alkali metal hydroxide, and mixtures thereof, with from about 40 to 90% of the soap being a tallow soap and about 60 to 10% of the soap being a coconut oil soap, about 1 to 10% of lanolin fatty acids, about 2 to 12% of a polyol of 3 to 6 carbon atoms and 2 to 6 hydroxyl groups, and about 5 to 25% of water.

2. A soap cake according to claim 1 which comprises about 60 to 84% of mixed tallow and coconut oil soaps of an alkali metal hydroxide, with from 50 to 85% of the soap being tallow soap and 50 to 15% of the soap being coconut oil soap, 2 to 8% of lanolin fatty acids, and 4 to 10% of a polyol selected from the group consisting of sorbitol, glycerol and maltitol, and mixtures thereof, and 9 to 20% of water.

3. A process for manufacture of translucent soap cakes which comprises mixing together at a temperature in the range of 65° to 95° C. about 45 to 90 parts of mixed tallow and coconut oil soaps which are soaps of a base selected from the group consisting of lower alkanolamine and alkali metal hydroxide, and mixtures thereof, with from about 40 to 90% of the soap being a tallow soap and about 60 to 10% of the soap being a coconut oil soap, about 1 to 10 parts of lanolin fatty acids, about 2 to 12 parts of a polyol of 3 to 6 carbon atoms and 2 to 6 hydroxy groups, and 25 to 50 parts of water, drying said mixture to a moisture content in the range of 5 to 25%, plodding such dried mixture into bars, cutting such bars into blanks and pressing such blanks into finished translucent soap cakes.

4. A process according to claim 3 wherein the mixing is high shear mixing and is conducted at a temperture in the range of 70° to 90° C., about 60 to 84 parts of mixed tallow and coconut oil soaps are present in the mixer and such soaps are of an alkali metal, with from 50 to 85% thereof being tallow soap and 50 to 15% being coconut oil soap, 2 to 8 parts of lanolin fatty acids are present, the polyol is selected from the group consisting of sorbitol, glycerol and maltitol, and mixtures thereof, and 4 to 10 parts are present, and 30 to 45 parts of water are present in the mixer, the drying is to a moisture content in the range of 10 to 20%, the dried mixture is mixed with perfume and the resulting mixture is milled before plodding.

5. A process for manufacture of translucent soap cakes which comprises mixing together at a temperature in the range of 65° to 95° C. about 45 to 90 parts of mixed tallow and coconut oil soaps which are soaps of a base selected from the group consisting of lower alkanolamine and alkali metal hydroxide, and mixtures thereof, with from about 40 to 90% of the soap being a tallow soap and about 60 to 10% of the soap being a coconut oil soap, about 1 to 10 parts of a lanolin soap mede in situ in the mixer in the presences of the mixed tallow and coconut oil soaps by reacting an excess of lanolin fatty acids with alkali at a temperature in the range of 70° to 90° C. to produce lanolin soap with free lanolin fatty acid present in the mixture after making of the lanolin soap, about 2 to 12 parts of a polyol of 3 to 6 carbon atoms and 2 to 6 hydroxy groups, and 25 to 50 parts of water, drying said mixture to a moisture content in the range of 5 to 25%, plodding such dried mixture into bars, cutting such bars into blanks and pressing such blanks into finished translucent soap cakes.

6. A process for manufacture of translucent soap cakes which comprises mixing together at a temperature in the range of 65° to 95° C. about 45 to 90 parts of mixed tallow and coconut oil soaps which are soaps of a base selected from the group consisting of lower alkanolamine and alkali metal hydroxide, and mistures thereof, with from about 40 to 90% of the soap being a tallow soap and about 60 to 10% of the soap being a coconut oil soap, about 1 to 10 parts of a lanolin soap made in situ in the mixer in the presences of the mixed tallow and coconut oil soaps by reacting an excess of lanolin fatty acids with alkali at a temperature in the range of 70° to 90° C. to produce lanolin soap with free lanolin fatty acid present in the mixture after making of the lanolin soap, 0.5 to 4 parts of lower alkanolamine isostearate soap, made in situ in the mixer simultaneously with the manufacture of the lanolin soap, by reacting isostearic acid with lower alkanolamine at a temperature in the range of 70° to 90° C., about 2 to 12 parts of a polyol of 3 to 6 carbon atoms and 2 to 6 hydroxy groups, and 25 to 50 parts of water, drying said mixture to a moisture content in the range of 5 to 25%, plodding such dried mixture into bars, cutting such bars into blanks and pressing such blanks into finished translucent soap cakes.

7. A process according to claim 3 wherein drying is effected at a temperature in the range of 40° to 100° C., the dried mixture is milled, and such milling and plodding are effected at a temperature in the range of 35° to 45° C.

8. A process for manufacture of translucent soap cakes which comprises mixing together at an elevated temperature components of a translucent soap, including lanolin fatty acids, to form a mixture, drying said mixture to a moisture content in the range of 5 to 25%, at which moisture content a worked, extruded and pressed cake of such composition will be translucent, working and extruding such dried mixture into bars, cutting such bars into blanks and pressing such blanks into finished translucent soap cakes.

9. A translucent soap cake which comprises 45 to 95% of soap of mixed animal fat and vegetable oil or corresponding fatty acids, which is a soap of a base selected from the group consisting of lower alkanolamine, alkali metal hydroxide and lower alkylamine, and mixtures thereof, 1 to 15% of lanolin fatty acids and about 5 to 25% of water, in which the lanolin fatty acids are present in such proportion as to promote translucency of the soap cake.

10. A transulucent soap-synthetic organic detergent cake which comprises 40 to 90% of soap of mixed animal fat and vegetable oil or corresponding fatty acids, which is a soap of a base selected from the group consisting of lower alkanolamine, alkali metal hydroxide and lower alkylamine, and mixtures thereof, and 5 to 55% of a normally solid synthetic organic detergent which is an anionic detergent, a nonionic detergent or an amphoteric detergent or a mixture of two or more thereof, 1 to 15% of lanolin fatty acids, and about 5 to 25% of water, in which the lanolin fatty acids are present in such proportion as to promote translucence of the soap-synthetic organic detergent cake.

11. A soap cake according to claim 10 which comprises about 76% of mixed sodium tallow and coconut oil soaps, with the proportions of such soaps being about 75% of tallow soap and about 25% of coconut oil soap, about 3% of lanolin fatty acids, about 6% of sorbitol and about 15% of water.

12. A translucent soap cake according to claim 9 which contains from 2 to 12% of a polyol of 3 to 6 carbon atoms and 2 to 6 hydroxyl groups to promote translucency of the soap cake and in which the proportion of soap of mixed animal fat and vegetable oil is 45 to 90% and the proportion of lanolin fatty acids is 1 to 10%.

13. A translucent-pearlescent soap cake according to claim 9 which comprises from 0.1 to 5% of finely divided pearlescent material in such proportion as to make the soap cake appear pearlescent.

14. A soap cake according to claim 13 wherein the pearlescent material is mica of a particle size below No. 325, U.S. Sieve Series, and from 0.3 to 0.8% thereof is present.

15. A translucent-pearlescent soap-synthetic organic detergent cake according to claim 10 which comprises from 0.1 to 5% of finely divided pearlescent material in such proportion as to make the soap cake appear pearlescent.

16. A process according to claim 3 wherein the mixture is dried to a moisture content below that desired in the final translucent soap cakes, additional moisture and perfume are added to the dried mixture in an amalgamator, with such proportion being such as to increase the moisture content of the mixture to such an extent, allowing for any losses of moisture in milling and plodding, so that the final cake moisture will be in the range of 10 to 20%, said moistened mixture is milled, and the milled chips resulting are plodded into bars, which are cut into blanks, which are pressed into finished translucent soap cakes.

17. A process according to claim 16 wherein the final desired bar moisture is in the range of 14 to 18%, the mixture is dried to a moisture content in the range of 11 to 15%, and 1 to 5% of moisture is added to the mixture in the amalgamator.

18. A process for the manufacture of translucent soap cakes which comprises saponifying a mixture of tallow, coconut oil and lanolin fatty acids with aqueous sodium hydroxide at an elevated temperature, with the proportion of lanolin fatty acids remaining after saponification being such as to promote translucency of a soap cake made from such soap tallow and coconut oil mixture, drying said mixture, with or without other anti-crystallization materials than the lanolin soap and lanolin fatty acids being present in the mixture, to a moisture content in the range of 5 to 25%, at which moisture content a worked, extruded and pressed cake of such composition will be translucent, working and extruding such dried mixture into bars, cutting such bars into blanks and pressing such blanks into finished translucent soap cakes.

19. A process according to claim 18 wherein the soaps are sodium soaps, the final cake moisture is in the range of 14 to 18%, the proportion of soaps resulting from saponification and present in the final cake is about 45 to 90 parts of sodium mixed tallow and coconut oil soaps, with from about 40 to 90% of such soaps being a tallow soap and about 60 to 10% of such soaps being a coconut oil soap, and about 1 to 10 parts of the lanolin fatty acids and 2 to 12 parts of a polyol of 3 to 6 carbon atoms and 2 to 6 hydroxy groups are present in the final cake to promote translucence.

20. A translucent soap cake which comprises from 68 to 79% of mixed sodium tallow and coconut oil soaps with the proportions of such soaps being 70 to 80% of tallow soap and 30 to 20% of coconut oil soap, about 0 to 8% of a lanolin soap of a base selected from the group consisting of lower alkanolamine, alkali metal hydroxide, ammonium hydroxide, and mixtures thereof, 2 to 4% lanolin fatty acids, 5 to 7% sorbitol and 14 to 18% of water.

* * * * *